US005253712A

United States Patent [19]

Swor

[11] Patent Number: 5,253,712

[45] Date of Patent: Oct. 19, 1993

[54] ROTATIONALLY OPERATED BACK PRESSURE VALVE

[76] Inventor: Loren C. Swor, 1313 W. Elder, Duncan, Okla. 73533

[21] Appl. No.: 844,814

[22] Filed: Mar. 2, 1992

[51] Int. Cl.[5] ..... E21B 34/06

[52] U.S. Cl. ..... 166/330; 166/332

[58] Field of Search ..... 166/373, 311, 312, 330, 166/332, 331

[56] References Cited

U.S. PATENT DOCUMENTS

| | | | |
|---|---|---|---|
| Re. 30,110 | 10/1979 | Huebsch et al. | 166/65 M |
| 2,944,793 | 7/1960 | Conrad | 255/24 |
| 3,830,306 | 8/1974 | Brown | 166/334 X |
| 3,990,511 | 11/1976 | Gazda | 166/224 R |
| 4,103,744 | 8/1978 | Akkerman | 166/324 |
| 4,160,484 | 7/1979 | Watkins | 166/317 |
| 4,415,038 | 11/1983 | Schmuck | 166/373 |
| 4,687,055 | 8/1987 | Leggett | 166/72 |
| 4,977,957 | 12/1990 | Pringle | 166/321 |
| 5,070,944 | 12/1991 | Hopper | 166/66.4 |

OTHER PUBLICATIONS

Exhibit A-Halliburton Services Sales & Service Catalog No. 43 (1985), pp. 2568-2569.

Exhibit B-Halliburton Services Sales & Service Catalog No. 43 (1985), p. 2573.

Exhibit C-Drawing (Undated but admitted to show prior art).

Exhibit D-Brochure of Baker Oil Tools Company, pp. 966-967 (Undated but admitted to be prior art).

Exhibit E-Brochure of Elder Oil Tools, p. 5 (Undated but admitted to be prior art).

*Primary Examiner*—Terry Lee Melius

*Attorney, Agent, or Firm*—James R. Duzan; L. Wayne Beavers

[57] ABSTRACT

A rotationally operated back pressure valve includes a flapper valve with a sliding stinger tube located thereabove in a housing. An operating mandrel has a lower end portion received in a bore of the housing and the operating mandrel extends upward out of the upper end of the housing. The operating mandrel may be connected to a work string for rotation by the work string. A threaded engagement is provided between the operating mandrel and the stinger tube so that the stinger tube can be selectively moved between a first and second position thereof relative to the housing in response to selected right-hand or left-hand rotation of the operating mandrel relative to the housing. In the first position of the stinger tube it is located above the flapper valve so that the flapper valve closes the housing bore. In the second position of the stinger tube it extends downward through the housing bore past the flapper valve to hold the flapper valve fully open. The tool includes locking lugs which lock the operating mandrel against rotation relative to the housing if tension is applied across the tool. This allows other tools located in the work string below the back pressure valve to be actuated by work string manipulation. When a compressional load is applied across the valve, the locking lugs disengage so as to allow rotational operation of the back pressure valve.

18 Claims, 5 Drawing Sheets

ROTATIONALLY OPERATED BACK PRESSURE VALVE

BACKGROUND OF THE INVENTION

1. Field Of The Invention

The present invention relates generally to back pressure valves, and more particularly, but not by way of limitation, to back pressure valves suitable for use in a workover string for acidizing of wells.

2. Description Of The Prior Art

During certain workover jobs on oil and gas wells, a tool known as a back pressure valve is run in the work string. The back pressure valve typically is a flapper type valve which when in a closed position prevents upward flow through the work string. The flapper is opened by a stinger tube which is pushed downward through the flapper. The operation of the stinger tube is typically controlled by a J-slot interconnection between the stinger tube and the housing which contains the flapper valve. Thus, the flapper valve is opened by the weight of the workover string above the back pressure valve which is available to be set down on the stinger tube to force the flapper open. Sometimes a difficulty is encountered when there are very high pressures contained in the workover string below the flapper. The back pressure valve is typically placed at a relatively high point in the work string near the surface, and thus the weight of the work string thereabove is sometimes inadequate to force the flapper open against the high internal pressures trapped below the flapper.

Thus, there is a need for a back pressure valve which can be operated reliably regardless of the pressures acting against the flapper and holding it closed.

SUMMARY OF THE INVENTION

The present invention provides an improved flapper type back pressure valve which can be positively and reliably opened regardless of the pressure trapped thereunder. This is accomplished by providing a rotational engagement means between the stinger tube and an operating mandrel of the valve so that the operating mandrel can be rotated by the work string. That rotation is translated into sliding motion of the stinger tube so as to force the flapper open. The work string can be rotated in the opposite direction to withdraw the stinger tube and allow the flapper to close.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
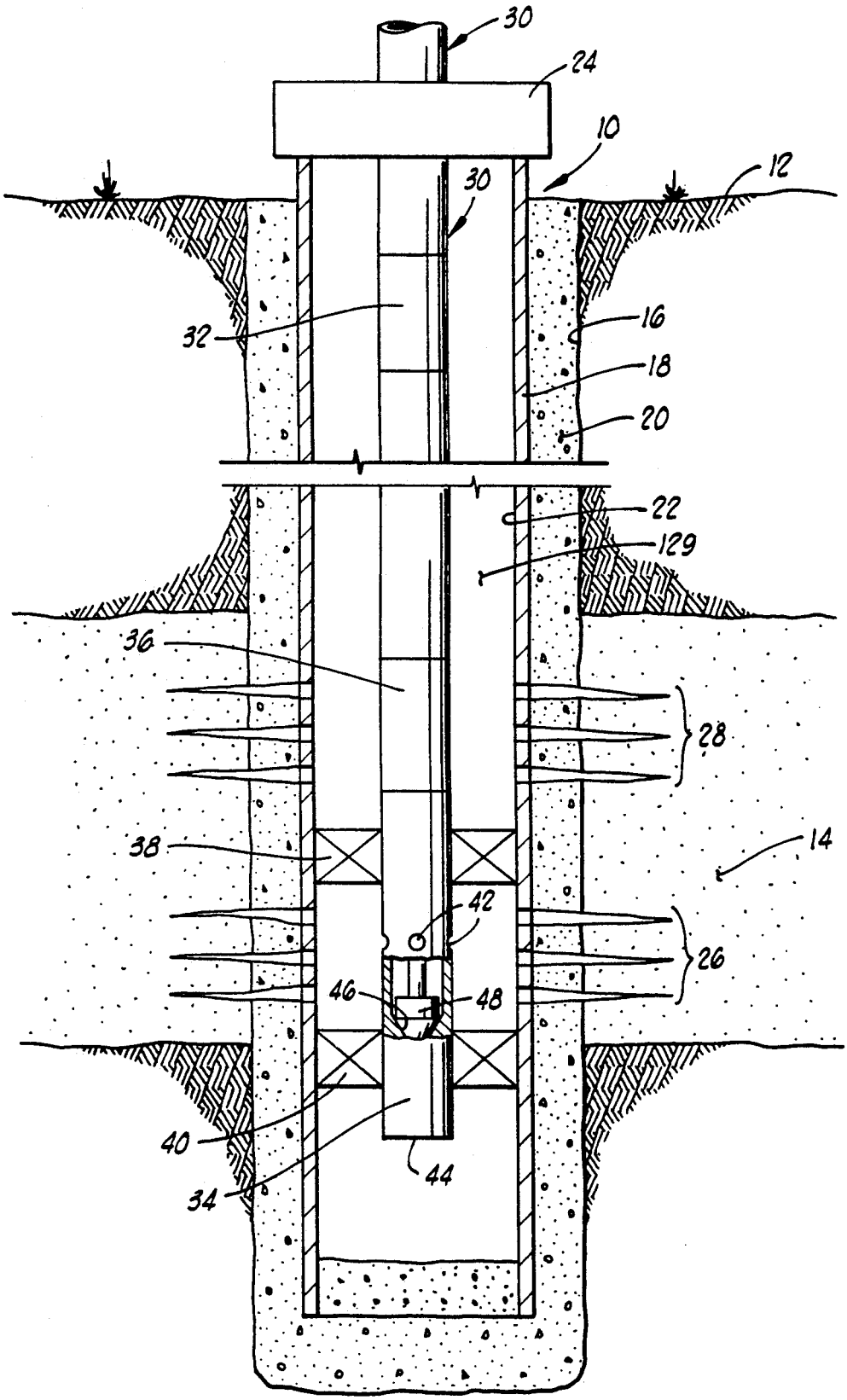
FIG. 1 is a schematic elevation sectioned view of a work string incorporating the rotationally operated back pressure valve of the present invention in place in a well to acidize the well.

FIG. 1 schematically illustrates a well 10 extending downward from the earth's surface 12 and penetrating a subterranean formation 14.

Well 10 is formed by a bore hole 16 extending down into the earth which has a well casing 18 cemented in place therein by cement 20. Casing 18 has a casing bore 22. On the upper end of casing 18 there is mounted a well head and blowout preventer assembly generally designated by the numeral 24.

The casing bore 22 is communicated with the subsurface formation 14 by a plurality of perforations such as a lower set of perforations 26 and an upper set of perforations 28.

It is common during the life of a well for the well to require certain workover operations to be conducted in order to maintain the efficiency of its production.

One commonly conducted workover operation is the acidizing of the well to stimulate increased production. This involves the pumping of acid into the formation 14 where the acid will act upon the formation surfaces it encounters so as to increase the production of hydrocarbons from the formation after the acid solution is removed.

The rotationally operated back pressure valve of the present invention is particularly useful in a workover string designed for conducting such acidizing operations, and improved methods of conducting acidizing operations using the rotationally operated back pressure valve of the present invention are disclosed herein. Nevertheless, the rotationally operated back pressure valve itself may be useful for many purposes other than the conducting of acidizing jobs.

In FIG. 1, a work string generally designated by the numeral 30 extends downward through the well head 24 into the well 10. The work string 30 may also be referred to as a pipe string or as including a pipe string 30 wherein the pipe string is made up typically of a plurality of threadedly connected pipe sections. Interconnected within the work string 30 at appropriate locations are the rotationally operated back pressure valve 32, a J-slot operated straddle injection packer 34, and a J-slot operated circulation valve 36.

The straddle injection packer 34 may for example be a Halliburton Pin Point Injection packer available from Halliburton Services of Duncan, Okla., as described at pages 2568–2569 of Halliburton Services, Sales & Service Catalog No. 43 (1985). The straddle packer 34 includes upper and lower packer elements 38 and 40, respectively. The packer elements 38 and 40 are compression set packer elements. The Halliburton Pin Point Injection packer is a J-slot operated tool. The packing elements 38 and 40 are set by picking up weight from the work string 30, rotating the work string 30 clockwise, i.e., with right-hand rotation as viewed from above, and then setting down weight on the work string. The packing elements 38 and 40 can subsequently be released by picking weight back up from the work string 30. Disposed in the straddle injection packer 34 between upper and lower packing elements 38 and 40 are a plurality of injection ports 42. The straddle injection packer 34 has an open lower end 44.

A seat 46 is defined within straddle injection packer 34. A wire line run and retrievable standing valve 48 may be set within the seat 48 to block the open lower end 44 and to cause fluid flowing down through the work string 30 to flow out the ports 42. The standing valve 48 may be retrieved to allow flow down through the open lower end 44 of straddle injection packer 34.

The circulating valve 36 may be a J-slot operated circulating valve such as for example a Halliburton RTTS circulating valve available from Halliburton Services of Duncan, Okla., as set forth in Halliburton Services, Sales & Service Catalog No. 43 (1985), at page 2573 thereof.

During an acidizing job it is common to include a back pressure valve in the work string 30, and the back pressure valve is generally located relatively near the surface 12. The back pressure valve can be described as being located nearer to the surface 12 than it is to the straddle injection packer 36 or to the perforations 26 and 28 communicating with the subsurface formation 14

An acidizing job typically involves initial steps of prewashing the perforations 26 and 28 with acid before the bulk of the acid solution is pumped into the formation 14 through those perforations. The prewashing is for the purpose of opening up the perforations.

This prewashing is accomplished generally in the following manner. The work string 30 is lowered into the well until the upper and lower packer elements 38 and 40 of straddle injection packer 34 straddle a lowermost set of perforations such as the perforations 26. The packing elements 38 and 40 are then set against the casing bore 22 by picking up weight from the work string 30, rotating the work string 30 clockwise and then setting down weight. The standing valve 48 is run into place if it is not already in place, and then an acid solution is pumped down the work string 30 and out the ports 42 and then into the lower set of perforations 26.

Weight is then picked up from the work string 30 to unset the packer elements 38 and 40 and the work string 30 is moved upward until the upper and lower packer elements 38 and 40 straddle the next higher set of perforations such as for example perforations 28. The packer elements 38 and 40 are again set within the casing bore 20 so as to isolate the upper perforations 28 and an acid prewash is performed on the upper perforations 28. This is continued in an upward going manner until all of the perforations have been prewashed.

Then the straddle injection packer 34 is located with both its upper and lower packing elements 38 and 40 above the uppermost perforations such as perforations 28, and the packing elements 38 and 40 are again set within the casing bore 22. Then, the standing valve 48 is removed and a large volume of acid solution is pumped down through the work string 30 out the open lower end 44 of straddle injection packer 34 and into all of the perforations such as 26 and 28 and out into the formation 14 to perform the main acidizing treatment of the subsurface formation 14.

During this operation, and particularly after the prewash operation and before the beginning of the main acid injection operation, high pressure fluids may begin to be produced out of the subsurface formation 14 and up into the work string 30.

The function of the back pressure valve 32 is to prevent formation fluids from flowing upward through the work string 30 at times when acid solution is not being pumped down the work string.

A problem has been encountered with typical prior art J-slot operated type back pressure valves in that sometimes the pressure which builds up in the work string 30 below the back pressure valve may be so high that there is insufficient weight of the pipe string located above the back pressure valve to open the back pressure valve against the high pressure pushing upward against the flapper element of the back pressure valve. This problem is solved by the rotationally operated back pressure valve 32 disclosed herein which is illustrated and described in detail with reference to FIGS. 2A–2G.

Figure 2A:
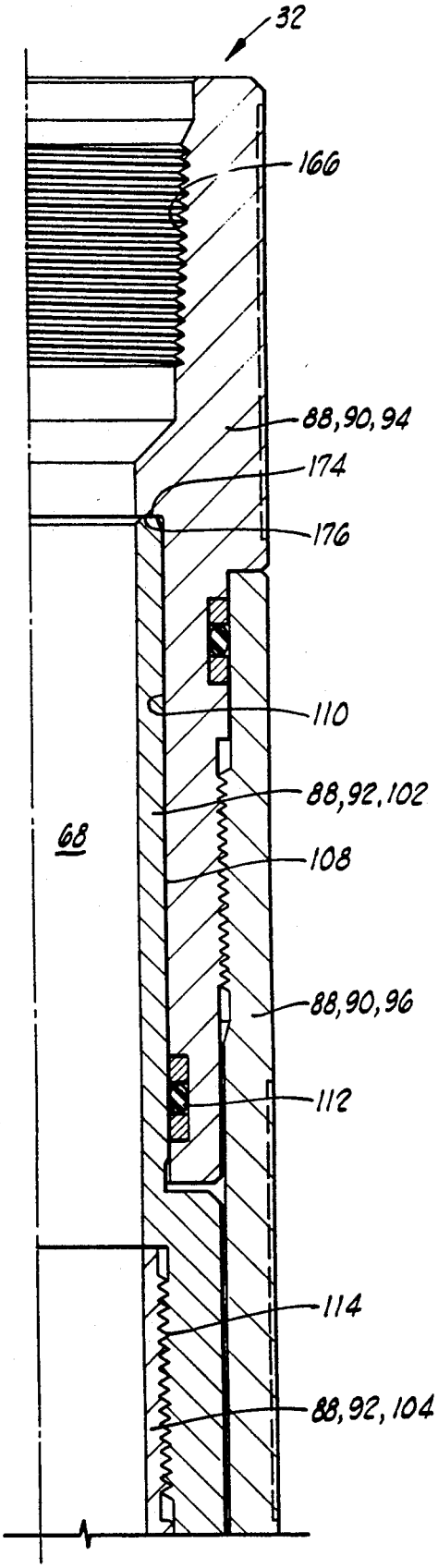
FIGS. 2A–2G comprise an elevation sectioned right-side only view of the rotationally operated back pressure valve.
Figure 2B:
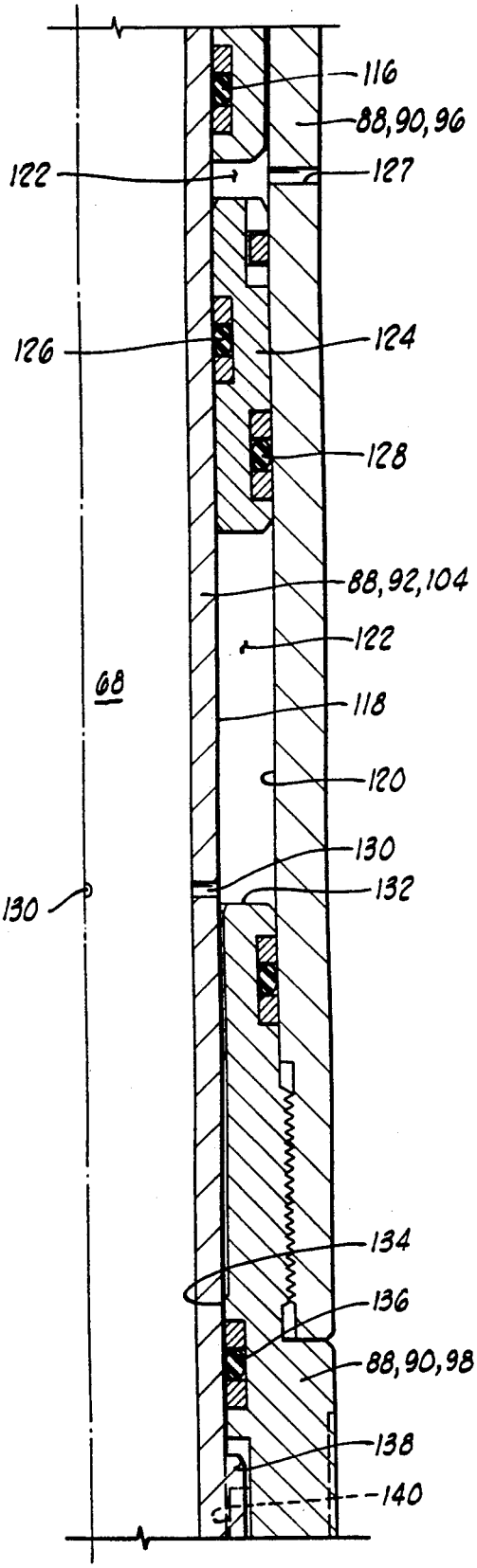
Figure 2C:
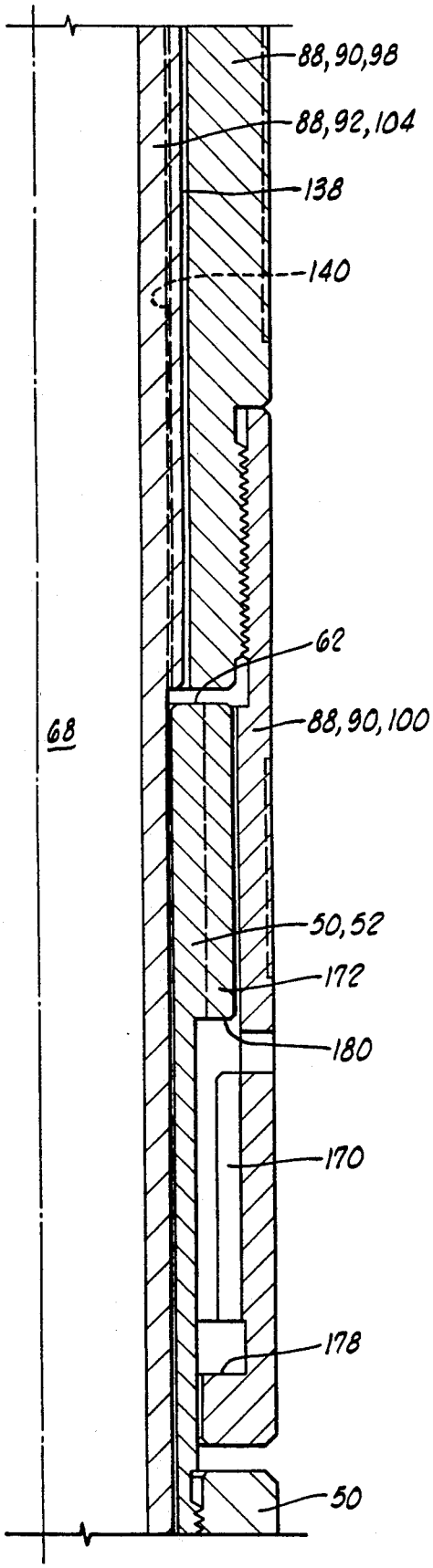
Figure 2D:
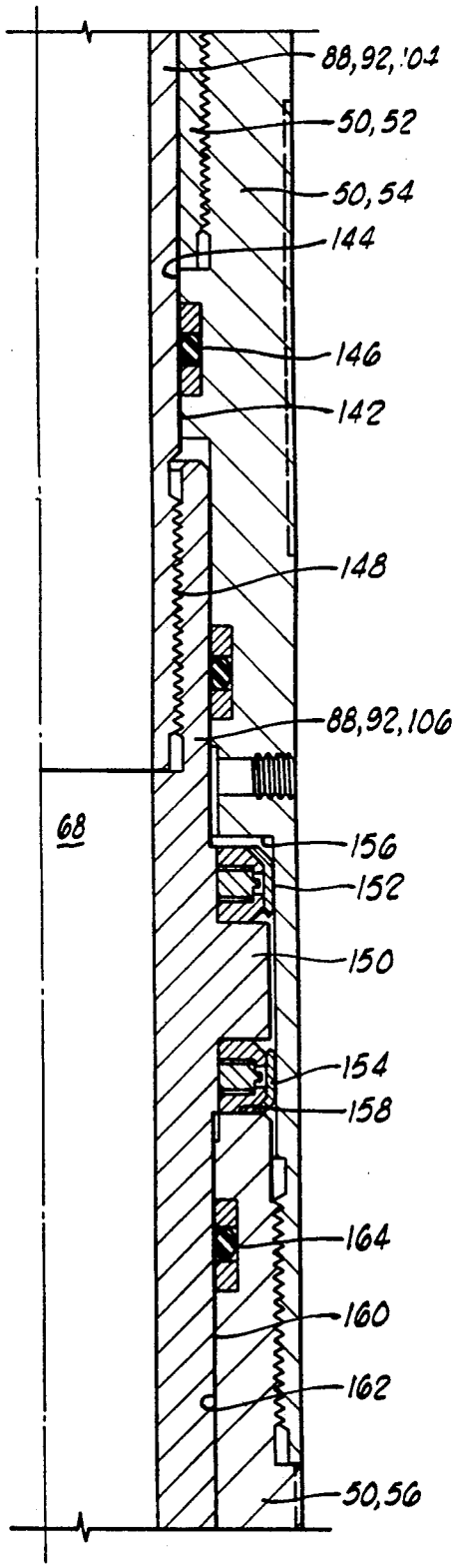

As seen in FIGS. 2C–2G, the back pressure valve 32 includes a housing generally designated by the numeral 50. The housing 50 is made up of a number of tubular elements which are threadedly connected together. Beginning with the uppermost portion of the housing 50 as seen in FIG. 2C and working downward, the housing 50 includes an upper housing lug section 52, a bearing housing section 54, an intermediate housing adapter 56, a spline housing section 58 and a lower adapter 60.

The housing 50 has an upper end 62 and a lower end 64. An irregular shaped housing bore generally designated by the numeral 66 extends longitudinally through the housing 50 from lower end 64 to upper end 62. The lower end 64 of housing 50 may also be referred to as an open lower end 64 of housing bore 66 and the upper end 62 may also be referred to as an open upper end 62 of housing bore 66. As will be further described, the housing bore 66 is communicated with the bore of the work string 30 and also forms part of a longitudinal central passageway 68 which extends entirely through the back pressure valve 32 and communicates at either end with the bore of the work string 30.

Figure 2E:
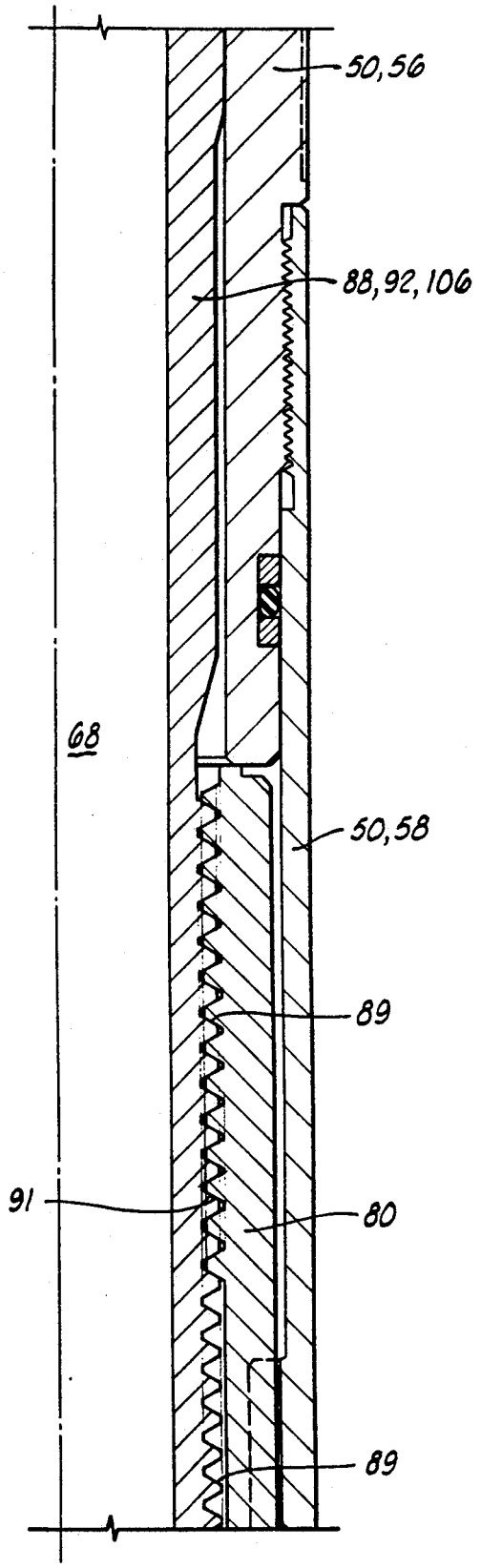
Figure 2F:
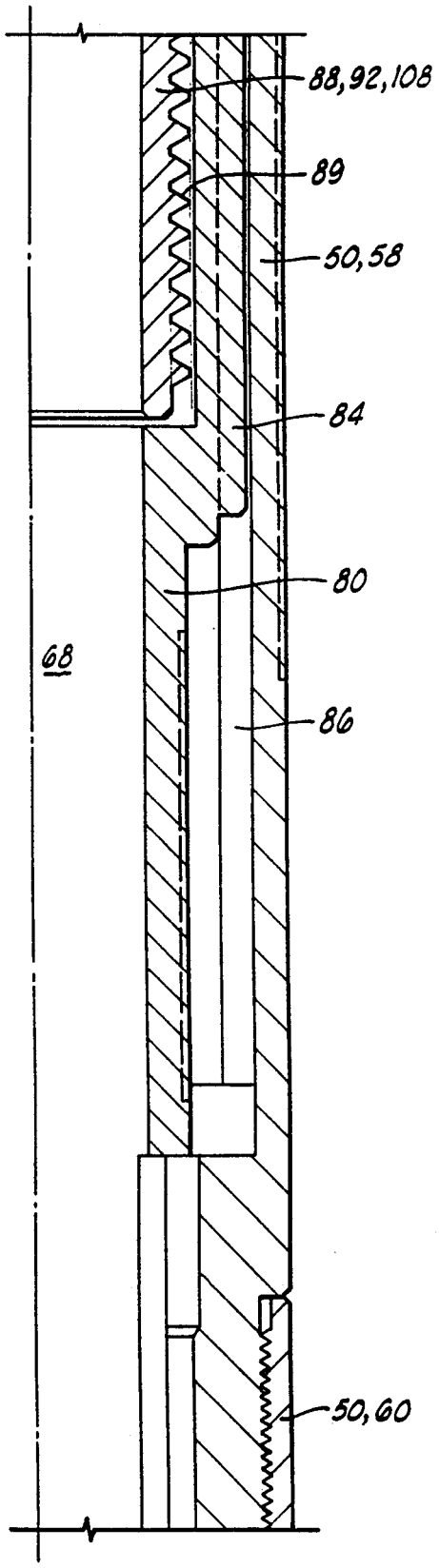
Figure 2G:
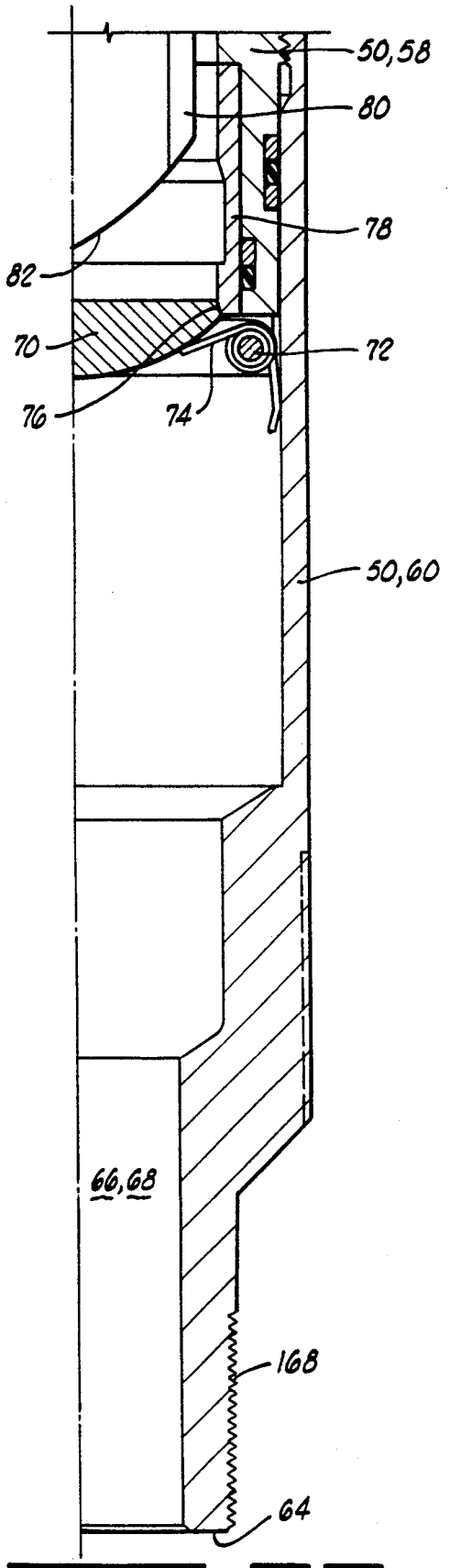

As seen in FIG. 2G, a flapper valve 70 is disposed in housing 50 and is pivotally connected thereto by pivot pin 72. A spring 74 biases the flapper valve 70 upward toward its closed position which is illustrated in FIG. 2G, wherein the flapper valve 70 closes the housing bore 66 and longitudinal passage 68. It will be appreciated that the flapper valve 70 can be pivoted downward to open the housing bore 66 and longitudinal passage 68. When the flapper valve 70 is in its closed position of FIG. 2G, it seals against an annular seat 76 defined in a seat ring 78 which is received in the lower end of the splined housing section 58 of housing 50.

As seen in FIGS. 2E–2G, a hollow stinger tube 80 is received in the housing bore 66. The stinger tube 80 has a curved lower end 82 which is located above flapper valve 70 when the flapper valve 70 is closed as seen in FIG. 2G. The stinger tube 80 has a plurality of radially outward extending splines 84 which are meshed with a plurality of inward extending splines 86 of spline housing section 58 to allow longitudinal sliding motion of stinger tube 80 relative to housing 50 while preventing rotational motion of stinger tube 80 relative to housing 50.

An operating mandrel assembly generally designated by the numeral 88 is rotatably mounted within the housing bore 66 and extends upward out the upper end 62 of housing 50. The operating mandrel 88 has an external or male thread 89 which is threadedly engaged with an internal or female thread 91 in the upper part of stinger tube 80. This threaded engagement between threads 89 and 91 provides a rotational engagement means 89, 91 operably associating the operating mandrel 88 and the stinger tube 80 for selectively moving the stinger tube 80 between a first position which is illustrated in FIGS. 2E–2G and a second position wherein the stinger tube 80 has moved downward relative to the housing 50. This movement of the stinger tube 80 is in response to selective right-hand or left-hand rotation of the work string 30 and the operating mandrel 88 which is attached thereto.

In the illustrated first position of the stinger tube 80, its lower end 82 is located above flapper 70 so that the flapper 70 is allowed to move to its closed position. Right-hand rotation of the operating mandrel 88 will cause the threaded connection 89, 91, which is a left-hand thread, to cause the stinger tube 80 to slide downward relative to housing 50 so that the lower end 82 engages flapper 70 and pushes flapper 70 open as the stinger tube 80 is pushed downward past flapper 70.

The stinger tube 80 can be withdrawn to allow the flapper 70 to reclose by left-hand rotation of the work string 30 and operating mandrel 88 thus causing the stinger tube 80 to slide back upward relative to housing 50 back to its first position.

The operating mandrel assembly 88 includes an upper operating mandrel assembly 90 and a lower operating mandrel assembly 92.

The upper operating assembly 90 includes an upper adapter 94, a balancing mandrel 96, a splined outer mandrel 98, and a lug mandrel 100, all of which are threadedly connected together.

The lower operating mandrel assembly 92 includes from top to bottom a guide mandrel 102, a splined inner mandrel 104 and a threaded mandrel 106.

As is further explained below, limited longitudinal sliding motion of upper mandrel assembly 90 is permitted relative to lower mandrel assembly 92.

The guide mandrel 102 includes a cylindrical outer surface 108 which is closely and slidably received within a bore 110 of upper adapter 94 with an O-ring seal 112 provided therebetween.

The guide mandrel 102 is threadedly connected to splined inner mandrel 104 at 114 with an O-ring seal 116 provided therebetween.

Splined inner mandrel 104 has a cylindrical outer surface 118 which is spaced radially inward from a cylindrical bore 120 of balancing mandrel 96 to define an annular balancing chamber 122 therebetween. An annular balancing piston 124 is received in chamber 122 and has inner and outer O-ring seals 126 and 128 which seal against surface 118 and bore 120, respectively.

A plurality of outer balancing ports 127 extend through the wall of balancing mandrel 96 to communicate chamber 122 above piston 124 with a well annulus 129 (see FIG. 1) between work string 30 and casing bore 22. A plurality of inner balancing ports 130 communicate chamber 122 below piston 124 with the longitudinal passage 68 and thus with the interior of work string 30. The balancing piston 124 and ports 127 and 130 provide a pressure balancing means which is operably associated with upper mandrel assembly 90 and lower mandrel assembly 92 for preventing creation of longitudinal loads across the back pressure valve 32 due to internal pressure within the housing bore 66 and longitudinal passageway 68. This balancing effect can best be appreciated when considering the situation which can occur as the flapper valve 70 is initially opened. There can be relatively high pressures built up below flapper valve 70 which will be quickly communicated with the passageway 68 above flapper valve 70 as soon as flapper valve 70 cracks open. This rapid pressure surge can cause an upward lifting force on the work string 30 which will tend to pull upward on the upper mandrel assembly 90. That upward force is offset, however, by this same pressure being communicated through balancing ports 130 into chamber 122 and acting downward on an upper end surface 132 of splined outer mandrel 98.

The outer surface 118 of splined inner mandrel 104 is closely received within a bore 134 of splined outer mandrel 98 with an O-ring seal 136 being provided therebetween. Splined inner mandrel 104 carries a plurality of radially outward extending splines 138 which are meshed with a plurality of radially inward extending splines 140 of splined outer mandrel 98 so as to allow longitudinal sliding motion of upper mandrel assembly 90 relative to lower mandrel assembly 92, while preventing relative rotational motion therebetween.

A lower cylindrical outer surface 142 of splined inner mandrel 104 is closely received within a bore 144 of bearing housing section 54 with an O-ring 146 provided therebetween.

Threaded mandrel 106 is connected to splined inner mandrel 104 at threaded connection 148. Threaded mandrel 106 carries a radially outward extending annular bearing flange 150 which is held in place between upper and lower bearings 152 and 154. The upper bearing 152, shoulder 150 and lower bearing 154 are sandwiched between a downward facing shoulder 156 of bearing housing section 54 and an upper end 158 of intermediate housing adapter 56. Thus the entire mandrel assembly 88 rotates relative to housing 50 on the bearings 152 and 154.

A cylindrical outer surface 160 of threaded mandrel 106 is closely received with a bore 162 of intermediate housing adapter 56 with an O-ring seal 164 provided therebetween. The lower portion of threaded mandrel 106 seen in FIGS. 2E–2F carries the thread 89 which engages the internal thread 91 of stinger tube 80 to provide the threaded operational engagement between operating mandrel assembly 88 and stinger tube 80.

The upper adapter 94 carries an internal thread 166 with which the back pressure valve 32 is connected to the upper portion of work string 30. The lower adapter 60 carries an external threaded pin connection 168 which is made up to the lower portion of the work string 30.

The lug mandrel 100 of upper operating mandrel assembly 90 carries a plurality of radially inward extending mandrel lugs 170. The upper housing lug section 52 carries a plurality of radially outward extending housing lugs 172. The back pressure valve 32 is shown in FIGS. 2A–2G in the position it will have when a compression load is applied longitudinally across the back pressure valve 32. In this position, the upper operating mandrel assembly 90 is in a downwardmost position relative to lower operating mandrel assembly 92 with an upper end 174 of guide mandrel 102 butted against a downward facing shoulder 176 of upper adapter 94. In this position, the mandrel lugs 170 are located below the housing lugs 172 as seen in FIG. 2C, and thus the operating mandrel assembly 88 can be rotated relative to the housing 50 to operate the threaded engagement 89, 91 between threaded mandrel 106 and stinger tube 80. When a tension load is placed longitudinally across the back pressure valve 32, however, the upper operating mandrel assembly 90 slides upward relative to housing 50 and the housing lugs 172 will mesh with the mandrel lugs 170. This upward sliding motion of upper mandrel assembly 90 relative to housing 50 terminates when an upward facing shoulder 178 of lug mandrel 100 abuts a lower end 180 of housing splines 172.

With the back pressure valve 32 in tension and with the housing lugs 172 meshed with mandrel lugs 170 relative rotation between the operating mandrel assembly 88 and the housing 50 is prevented. This allows J-slot operated tools such as the straddle injection packer 34 and circulating valve 36 of FIG. 1 to be operated without operating the threaded engagement 89, 91 of rotationally operated back pressure valve 32. The lugs 170 and 172 can be referred to as a locking means 170, 172 for locking the operating mandrel assembly 88 and housing 50 together to prevent relative rotation therebetween when a tension load is placed longitudinally across the rotationally operated back pressure valve apparatus 32.

Due to the positive mechanical opening action of the rotationally operated bypass valve 32, whereby rotational motion of the work string 30 while a compression load is applied across the back pressure valve 32 will cause the threaded engagement 89, 91 to definitely move the stinger tube 80 downward to open flapper valve 70, the rotationally operated back pressure valve 32 is capable of being opened against formation pressures trapped below flapper valve 70 which would be so high as to prevent a similarly located prior art J-slot operated back pressure valve from opening due to insufficient pipe string weight thereabove.

Methods Of Operation

The rotationally operated back pressure valve 32 has several functional advantages as compared to prior art valves. As discussed, its rotational operation provides for positive opening of the flapper valve regardless of the pressures therebelow. Additionally, the locking means provided by housing lugs 172 and mandrel lugs 170 allows the tool to be locked up so that J-slot operated tools located therebelow can be operated without changing the position of the flapper valve 70. While these attributes are particularly useful in acidizing operations like that previously described, they have a more general application to various types of workover operations.

In its more general aspects the method of utilizing the rotationally operated back pressure valve 32 can be described as including steps of:

(a) running into the well 10, the work string including a J-slot operated tool such as straddle injection packer 34 and/or circulating valve 36 and including the rotationally operated back pressure valve 32 located above the tool 34 or 36;

(b) picking up weight from the work string 30, rotating the work string 30 and then setting down weight on the work string 30 thereby operating the J-slot operated tool, e.g., operating the straddle injection packer 34 to set the packing elements 38 and 40 thereof;

(c) during the picking up and rotating of step (b), locking the rotationally operated back pressure valve 32 by means of lugs 172 and 170 to prevent operation of the threaded connection 89, 91 during the work string manipulations utilized to operate the straddle injection packer 34 located therebelow; and (d) during the setting down of weight on the drill string of step (b), unlocking the rotationally operated back pressure valve by sliding the lug 170 downward out of engagement with the lugs 172.

With particular reference to the acidizing job previously described with regard to FIG. 1, the methods of utilizing the rotationally operated back pressure valve 32 can generally be described as follows.

The work string 30 is run into the well 10 and the packer 34 is set as shown in FIG. 1.

The flapper valve 70 will typically be in a closed position when beginning an acidizing job. The prewashing of perforations, as illustrated in FIG. 1 is performed with the flapper valve 70 in its closed position; fluid pressure above flapper 70 will temporarily open flapper 70 as acid solution is pumped down through work string 30 to prewash the perforations.

As described above, the perforations are prewashed in stages progressing upwardly. After the uppermost perforations 28 are washed the work string 30 is raised and the straddle injection packer 34 is reset with packing element 40 above all perforations 26 and 28. The standing valve 48 is then retrieved.

When it is desired to open the flapper valve 70 prior to beginning the final acid washing job, the work string 30 is rotated while setting down weight across the tool 30, which can generally be described as rotating the work string 30 without placing tension across the back pressure valve 32, thereby moving the stinger tube 80 downward and opening the flapper valve 70. The rotation of the work string 30 is translated into sliding movement of stinger tube 80 by the threaded engagement 89, 91, so that the stinger tube 80 will push the flapper valve 70 open.

As previously mentioned, the positive mechanical operation of flapper valve 70 with stinger tube 80 as driven by the threaded engagement 89, 91 allows the rotationally operated back pressure valve 32 to be opened against formation pressures trapped below flapper valve 70 which are so high that a conventional J-slot operated flapper type back pressure valve would not be operable due to insufficient work string weight thereabove.

The stinger tube 80 holds the flapper valve 70 in a fully open position so as to allow an unimpeded flow area for the large volumes of acid solution which are pumped down the work string 30 and out the open lower end 44 thereof to acidize the formation 14.

Throughout this procedure, the pressure balancing chamber 122 and associated piston 124 and balancing ports 127 and 130 pressure balance the back pressure valve 32 and prevents creation of longitudinal loads across the back pressure valve 32 due to internal pressure within the work string 30.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A rotationally operated back pressure valve apparatus for use in a well, comprising:

a housing having an upper end and a lower end and having a housing bore defined therethrough from said lower end to said upper end;

a flapper valve disposed in said housing, said flapper valve having a closed position for sealing said housing bore against upward flow therethrough and having an open position wherein said flapper valve is pivoted downward in said housing from its closed position, thereby opening said housing bore;

a hollow stinger tube received in said housing bore and having a lower end, said tube being slidable within said housing between a first position wherein said lower end of said stinger tube is located above said flapper valve and a second position wherein said lower end of said stinger tube is located below said flapper valve and said stinger tube holds said flapper valve in its said open position, said stinger tube having a stinger bore therethrough; and an operating mandrel rotatably mounted in said housing bore and extending upward out of said upper end of said housing, said operating mandrel having a threaded engagement with said stinger tube so that rotation of said operating mandrel a plurality of full turns in a first direction relative to said housing translates into sliding motion of said stinger tube from its said first position to its said second position, and so that rotation of said operating mandrel in a second direction a like number of turns relative to said housing translates into sliding motion of said stinger tube from its said second position to its said first position.

2. A rotationally operated back pressure valve apparatus for use in a well, comprising:

a housing having an upper end and a lower end and having a housing bore defined therethrough from said lower end to said upper end;

a flapper valve disposed in said housing, said flapper valve having a closed position for sealing said housing bore against upward flow therethrough and having an open position wherein said flapper valve is pivoted downward in said housing from its closed position, thereby opening said housing bore;

a hollow stinger tube received in said housing bore and having a lower end, said tube being slidable within said housing between a first position wherein said lower end of said stinger tube is located above said flapper valve and a second position wherein said lower end of said stinger tube is located below said flapper valve and said stinger tube holds said flapper valve in its said open position, said stinger tube having a stinger bore therethrough;

an operating mandrel rotatably mounted in said housing bore and extending upward out of said upper end of said housing, said operating mandrel having a threaded engagement with said stinger tube so that rotation of said operating mandrel in a first direction relative to said housing translates into sliding motion of said stinger tube from its said first position to its said second position, and so that rotation of said operating mandrel in a second direction relative to said housing translates into sliding motion of said stinger tube from its said second position to its said first position; and locking means for locking said operating mandrel and said housing together to prevent relative rotation therebetween when a tension load is placed longitudinally across said apparatus.

3. The apparatus of claim 2, wherein:

said operating mandrel includes a lower mandrel portion which is rotatably received in said housing bore and extends above said upper end of said housing, and an upper mandrel portion slidably connected to said lower mandrel portion; and said locking means includes interlocking housing lugs defined on said housing and mandrel lugs defined on said upper mandrel portion, said lugs being in interlocking engagement when said tension load is placed across said apparatus, and said upper mandrel portion sliding downward relative to said housing to disengage said lugs when a compression load is placed across said apparatus.

4. The apparatus of claim 3, further comprising:

pressure balancing means, operably associated with said upper and lower mandrel portions, for preventing creation of longitudinal loads across said apparatus due to internal pressure in said housing bore.

5. A back pressure valve apparatus for use in a well, comprising:

a housing having upper and lower ends and having a housing bore extending therethrough from a lower end opening to an upper end opening;

a flapper valve disposed in said housing bore;

a stinger tube received in said housing bore;

an operating mandrel having a mandrel lower end received in said housing bore, said operating mandrel extending upward out of said upper end opening of said housing bore; and rotational engagement means, operably associating said operating mandrel and said stinger tube, for selectively moving said stinger tube between a first position and a second position relative to said housing in response to selected right-hand or left-hand rotation of said operating mandrel a plurality of full rotations relative to said housing, said first position being defined by said stinger tube being located above said flapper valve so that said flapper valve closes said housing bore, and said second position being defined by said stinger tube extending downward through said housing bore past said flapper valve to hold said flapper valve open.

6. The apparatus of claim 5, wherein:

said operating mandrel includes an upper adapter means for connecting said operating mandrel to a pipe string so that said operating mandrel can be rotated by said pipe string.

7. The apparatus of claim 6, wherein:

said rotational engagement means is constructed so that right-hand rotation of said pipe string moves said stinger tube from its said first position to its said second position to open said flapper valve, and so that left-hand rotation of said pipe string moves said stinger tube from its said second position to its said first position to allow said flapper valve to close.

8. A back pressure valve apparatus for use in a well, comprising:

a housing having upper and lower ends and having a housing bore extending therethrough from a lower end opening to an upper end opening;

a flapper valve disposed in said housing bore;

a stinger tube received in said housing bore;

an operating mandrel having a mandrel lower end received in said housing bore, said operating mandrel extending upward out of said upper end opening of said housing bore;

rotational engagement means, operably associating said operating mandrel and said stinger tube, for selectively moving said stinger tube between a first position and a second position relative to said housing in response to selected right-hand or left-hand rotation of said operating mandrel relative to said housing, said first position being defined by said stinger tube being located above said flapper valve so that said flapper valve closes said housing bore, and said second position being defined by said stinger tube extending downward through said housing bore past said flapper valve to hold said flapper valve open; and locking means for locking said operating mandrel and said housing together to prevent relative rotation therebetween when a tension load is placed longitudinally across said apparatus.

9. The apparatus of claim 8, wherein:

said operating mandrel includes a lower mandrel portion which is rotatably received in said housing bore and extends out of said upper end opening of said housing bore, and an upper mandrel portion slidably connected to said lower mandrel portion; and said locking means includes interlocking housing lugs defined on said housing and mandrel lugs defined on said upper mandrel portion, said lugs being in interlocking engagement when said tension load is placed across said apparatus, and said upper mandrel portion sliding downward relative to said housing to disengage said lugs when a compression load is placed across said apparatus.

10. The apparatus of claim 9, further comprising:

pressure balancing means, operably associated with said upper and lower mandrel portions, for preventing creation of longitudinal loads across said apparatus due to internal pressure in said housing bore.

11. A tool string for use in a well, comprising:

a pipe string;

a first J-slot operated tool disposed in said pipe string; and a rotationally operated back pressure valve disposed in said pipe string above said first J-slot operated tool, said back pressure valve including locking means for disabling said back pressure valve when a longitudinal load in a first direction is applied across said back pressure valve and for thereby allowing said J-slot operated tool to be operated without operating said back pressure valve.

12. The tool string of claim 11, wherein:

said longitudinal load in said first direction is a tension load across said back pressure valve, said back pressure valve being operable when a compression load is applied across said back pressure valve.

13. The tool string of claim 11, wherein:

said first J-slot operated tool is a straddle injection packer.

14. The tool string of claim 11, wherein:

said rotationally operated back pressure valve is capable of being opened by rotation of said pipe string against formation pressures high enough to prevent a similarly located J-slot operated back pressure valve from opening due to insufficient pipe string weight thereabove.

15. The tool string of claim wherein said rotationally operated back pressure valve further comprises:

a housing having upper and lower ends and having a housing bore extending therethrough from a lower end opening to an upper end opening;

a flapper valve disposed in said housing bore;

a stinger tube received in said housing bore;

an operating mandrel having a mandrel lower end received in said housing bore, said operating mandrel extending upward out of said upper end opening of said housing bore; and rotational engagement means, operably associating said operating mandrel and said stinger tube, for selectively moving said stinger tube between a first position and a second position relative to said housing in response to selected right-hand or left-hand rotation of said operating mandrel relative to said housing, said first position being defined by said stinger tube being located above said flapper valve so that said flapper valve closes said housing bore, and said second position being defined by said stinger tube extending downward through said housing bore past said flapper valve to hold said flapper valve open.

16. The tool string of claim 15, wherein:

said rotational engagement means is constructed so that right-hand rotation of said pipe string moves said stinger tube from its said first position to its said second position to open said flapper valve, and so that left-hand rotation of said pipe string moves said stinger tube from its said second position to its said first position to allow said flapper valve to close.

17. The tool string of claim 15, wherein:

said operating mandrel includes a lower mandrel portion which is rotatably received in said housing bore and extends out of said upper end opening of said housing bore, and an upper mandrel portion slidably connected to said lower mandrel portion; and said locking means of said rotationally operated back pressure valve includes interlocking housing lugs defined on said housing and mandrel lugs defined on said upper mandrel portion, said lugs being in interlocking engagement when said longitudinal load in said first direction is placed across said rotationally operated back pressure valve, and said upper mandrel portion sliding relative to said housing to disengage said lugs when a longitudinal load in a second direction opposite said first direction is placed across said rotationally operated back pressure valve.

18. The tool string of claim 17, wherein said rotationally operated back pressure valve further comprises:

pressure balancing means, operably associated with said upper and lower mandrel portions, for preventing creation of longitudinal loads across said rotationally operated back pressure valve due to internal pressure in said housing bore.

* * * * *